US011913327B2

(12) United States Patent
Richards

(10) Patent No.: US 11,913,327 B2
(45) Date of Patent: Feb. 27, 2024

(54) DOWNHOLE ROTATING CONNECTION

(71) Applicant: Schlumberger Technology Corporation, Sugar Land, TX (US)

(72) Inventor: Edward Richards, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 99 days.

(21) Appl. No.: 17/771,869

(22) PCT Filed: Oct. 29, 2020

(86) PCT No.: PCT/US2020/057954
§ 371 (c)(1),
(2) Date: Apr. 26, 2022

(87) PCT Pub. No.: WO2021/087108
PCT Pub. Date: May 6, 2021

(65) Prior Publication Data

US 2022/0389812 A1 Dec. 8, 2022

Related U.S. Application Data

(60) Provisional application No. 62/928,376, filed on Oct. 31, 2019.

(51) Int. Cl.
*E21B 47/24* (2012.01)
*E21B 34/06* (2006.01)
*E21B 47/18* (2012.01)

(52) U.S. Cl.
CPC ..... *E21B 47/24* (2020.05); *E21B 34/066* (2013.01); *E21B 47/18* (2013.01)

(58) Field of Classification Search
CPC ..... E21B 34/066; E21B 47/18; E21B 47/24
See application file for complete search history.

(56) References Cited

U.S. PATENT DOCUMENTS 3,982,224 A * 9/1976 Patton ..... E21B 47/20 367/84
4,550,392 A * 10/1985 Mumby ..... E21B 47/24 175/45
4,630,244 A * 12/1986 Larronde ..... E21B 47/18 367/84
4,708,163 A * 11/1987 Deaton ..... E21B 34/08 137/460

(Continued)

FOREIGN PATENT DOCUMENTS

EP 0747571 A2 * 12/1996 ..... E21B 47/18
WO 9320462 A1 10/1993

OTHER PUBLICATIONS

International Search Report and Written Opinion in International Patent Application No. PCT/US2020/057954, dated Feb. 2, 2020, 8 pages.

*Primary Examiner* — Jennifer H Gay
(74) *Attorney, Agent, or Firm* — Jeffrey D. Frantz

(57) ABSTRACT

A downhole connection includes a rotating member and an independently rotating member. A solenoid is connected to the independently rotating member and a moving member is connected to the rotating member. The moving member is movable by the solenoid and connected to an actuation valve of a downhole tool on the rotating member.

21 Claims, 12 Drawing Sheets

(56) References Cited

U.S. PATENT DOCUMENTS 4,725,197 A * 2/1988 Russell ..... H02K 49/106 417/420
4,736,791 A * 4/1988 Rorden ..... E21B 34/066 340/855.8
4,878,053 A * 10/1989 Rorden ..... E21B 34/066 340/854.6
4,914,637 A * 4/1990 Goodsman ..... F16K 47/00 367/83
5,113,379 A * 5/1992 Scherbatskoy ..... E21B 47/017 367/83
5,586,083 A * 12/1996 Chin ..... E21B 47/18 175/48
5,787,052 A 7/1998 Gardner et al.
6,138,754 A * 10/2000 Veneruso ..... F16K 31/04 417/63
6,325,153 B1 * 12/2001 Harrell ..... E21B 34/066 166/383
6,364,023 B1 * 4/2002 Hiron ..... E21B 34/066 166/373
6,484,817 B2 * 11/2002 Innes ..... E21B 47/24 175/48
6,714,138 B1 * 3/2004 Turner ..... E21B 47/20 340/856.4
8,693,284 B2 * 4/2014 Allan ..... E21B 47/24 367/83
9,091,143 B2 * 7/2015 Segura ..... E21B 23/00
9,133,950 B2 * 9/2015 Gopalan ..... E21B 47/20
9,556,682 B2 * 1/2017 Fuller ..... E21B 10/322
9,879,528 B2 * 1/2018 Pratt ..... E21B 47/24
10,316,652 B2 * 6/2019 Lee ..... E21B 47/24
10,465,506 B2 * 11/2019 Barbely ..... E21B 47/18
11,268,345 B2 * 3/2022 Segura ..... E21B 47/18
11,359,486 B2 * 6/2022 Zhan ..... E21B 21/12
11,608,738 B2 * 3/2023 Carminati ..... H04B 11/00
11,753,932 B2 * 9/2023 Sauthoff ..... E21B 34/06 367/84
2002/0008634 A1 * 1/2002 Innes ..... E21B 47/24 340/854.3
2007/0235227 A1 * 10/2007 Kirkhope ..... E21B 7/062 175/73
2010/0157735 A1 * 6/2010 Allan ..... E21B 47/24 367/83
2012/0273271 A1 * 11/2012 Stuart-Bruges ..... E21B 47/24 340/853.3
2013/0056195 A1 * 3/2013 Sihler ..... E21B 17/05 166/65.1
2013/0248203 A1 * 9/2013 Scott ..... E21B 34/066 166/373
2014/0124693 A1 * 5/2014 Gopalan ..... E21B 47/20 251/359
2014/0262525 A1 * 9/2014 Fuller ..... E21B 10/322 175/57
2014/0340991 A1 11/2014 Ortiz et al.
2015/0090494 A1 * 4/2015 Lazarev ..... G06K 19/0772 175/40
2015/0260014 A1 * 9/2015 Zimmerman ..... E21B 47/18 166/66.5
2017/0167252 A1 * 6/2017 Pratt ..... E21B 47/24
2017/0260832 A1 * 9/2017 Green ..... E21B 47/18
2017/0268331 A1 * 9/2017 Lee ..... E21B 47/20
2018/0128099 A1 * 5/2018 Barbely ..... E21B 47/12
2018/0156033 A1 * 6/2018 Hempel ..... E21B 17/04
2019/0211673 A1 * 7/2019 Gopalan ..... E21B 34/16
2019/0301267 A1 * 10/2019 Segura ..... E21B 41/00
2020/0392810 A1 * 12/2020 Segura ..... E21B 23/00
2021/0372278 A1 * 12/2021 Sauthoff ..... E21B 47/18
2022/0170364 A1 * 6/2022 Carminati ..... E21B 47/24
2022/0372869 A1 * 11/2022 Richards ..... E21B 47/18
2022/0372870 A1 * 11/2022 Hough ..... E21B 47/24
2022/0389812 A1 * 12/2022 Richards ..... E21B 34/066
2023/0125784 A1 * 4/2023 Parkin ..... E21B 47/18 175/40

* cited by examiner

DOWNHOLE ROTATING CONNECTION

CROSS-REFERENCE TO RELATED APPLICATIONS

This application is a National Stage Entry of International Application No. PCT/US2020/057954, filed on Oct. 29, 2020, which claims the benefit of, and priority to, U.S. Patent Application No. 62/928,376, filed on Oct. 31, 2019 and titled "DOWNHOLE ROTATING CONNECTION". Each of the foregoing application is incorporated herein by this reference in its entirety.

BACKGROUND

Downhole drilling tools often rotate to drill, ream, or otherwise degrade material in a downhole environment. Many downhole drilling tools include sections that rotate independently of each other. For example, roll stabilized platforms are often held rotationally stable with respect to a borehole wall, and used in directional drilling applications to provide a reference for an operator on the surface, or a downhole control unit, to direct the bit on a desired trajectory (e.g., to direct the azimuth and/or inclination of the bit). The roll stabilized platform may collect data, such as measurements from sensors, which may be beneficial to communicate from the roll stabilized platform to other portions of a drilling system.

SUMMARY

In some embodiments, a downhole connection includes a rotating member and an independently rotating member. The independently rotating member is rotatable relative to the rotating member. A solenoid is rotationally fixed to the independently rotating member and a moving member is connected to the rotating member. The moving member is movable by the solenoid and connected to an actuation valve of a downhole tool rotationally connected to the rotating member.

In some embodiments, a mud pulse telemetry system includes a rotating member that includes a mud pulse generator. The mud pulse generator includes a low pressure position and a high pressure position. A roll stabilized platform is rotatable relative to the rotating member. A valve includes a solenoid rotationally fixed to the roll stabilized platform and a moving member configured to move longitudinally with respect to the solenoid from a first position to a second position, based on the activation of the solenoid.

In some embodiments, a method for operating a downhole connection includes rotating a rotating member with a first rotational rate. An independently rotating member is rotated with a second rotational rate. A solenoid on the independently rotating member is activated, which actuates a moving member. Actuating the moving member may activate a downhole tool.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a cross-sectional view of a downhole connection, according to at least one embodiment of the present disclosure;

FIG. 2-2 is another cross-sectional view of the downhole connection of FIG. 2-1, according to at least one embodiment of the present disclosure;

FIG. 4-1 through FIG. 4-5 are cross sectional views of a solenoid, according to at least one embodiment of the present disclosure;

FIG. 5-1 is a cross-sectional view of a downhole connection, according to at least one embodiment of the present disclosure;

FIG. 5-2 is another cross-sectional view of the downhole connection of FIG. 5-1, according to at least one embodiment of the present disclosure;

FIG. 7-1 is a cross-sectional view of a mud-pulse telemetry system, according to at least one embodiment of the present disclosure;

FIG. 7-2 is another cross-sectional view of the mud-pulse telemetry system of FIG. 7-1, according to at least one embodiment of the present disclosure;

DETAILED DESCRIPTION

Figure 1:
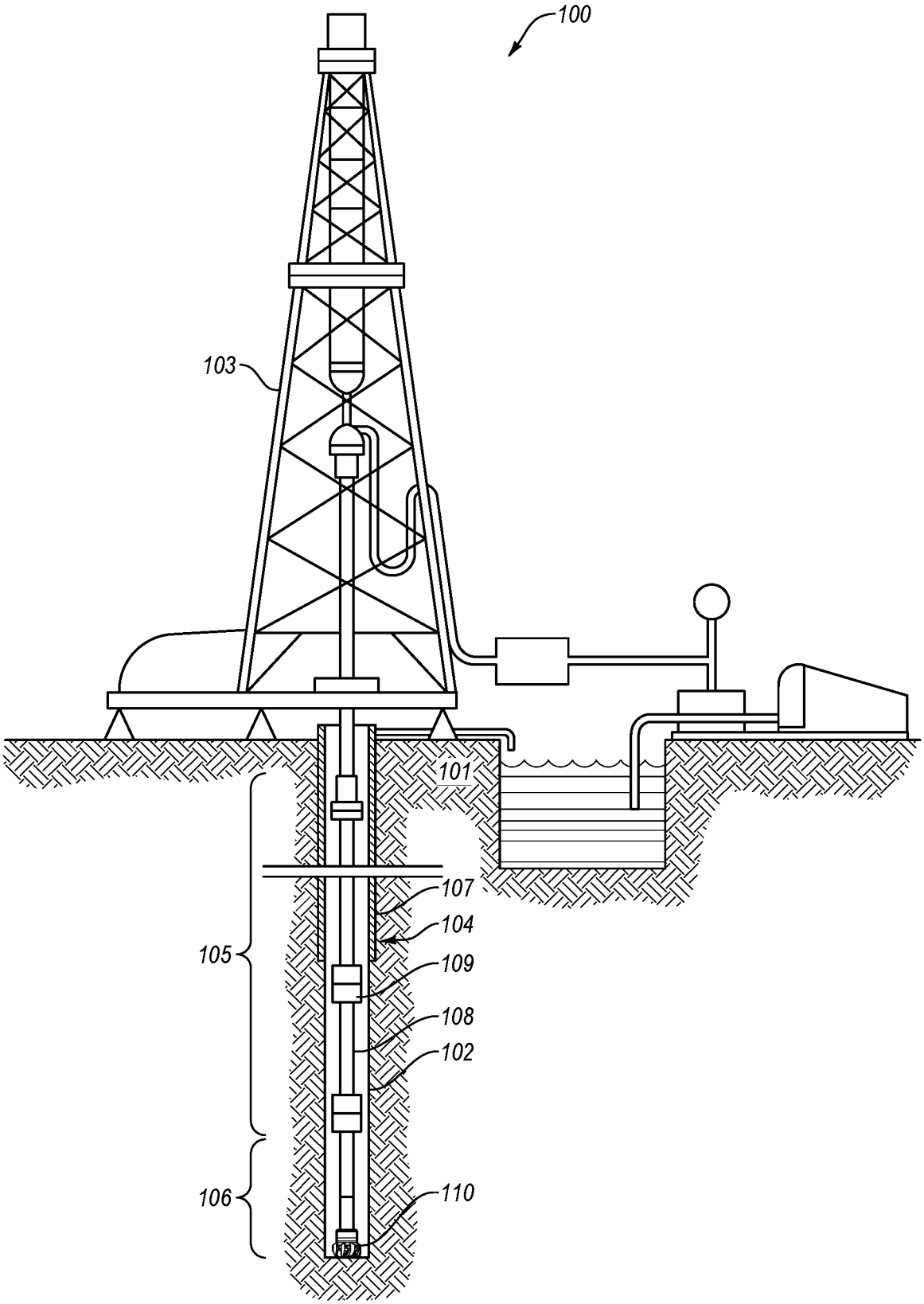
FIG. 1 is a drilling system, according to at least one embodiment of the present disclosure.

This disclosure generally relates to devices, systems, and methods for a connection between a rotating member and a non-rotating member in a downhole drilling environment. FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory. In some embodiments at least a portion of the RSS may roll-stabilized and may not rotate with the drill collar. In such embodiments, such a portion of the RSS may be geostationary or may be controlled in such a way so as to control the direction of the drill string.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
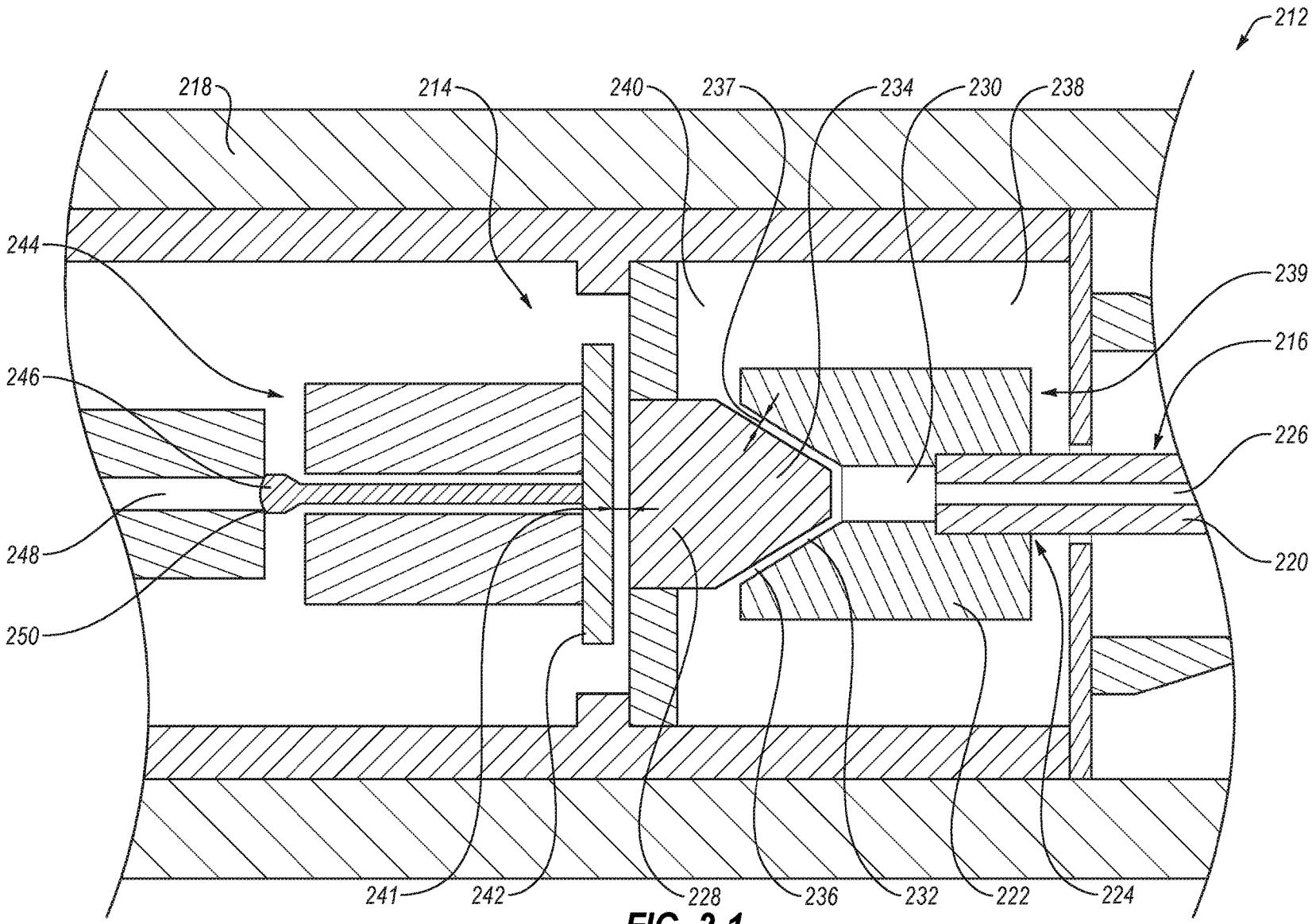
Figure 2:
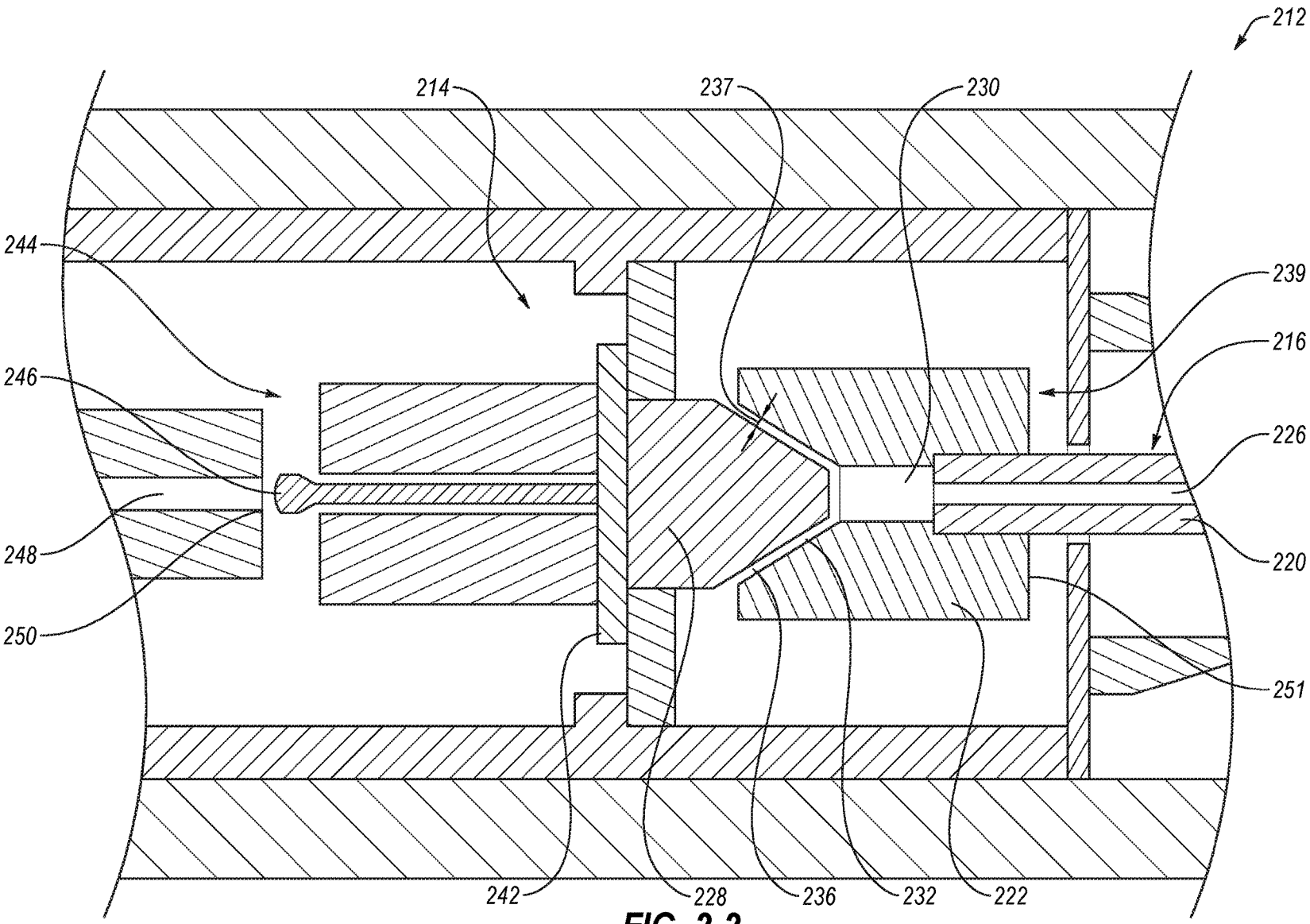

FIG. 2-1 is a representation of a downhole connection 212, according to at least one embodiment of the present disclosure. The downhole connection 212 may include a rotating member 214 and an independently rotating member 216. The rotating member 214 and the independently rotating member 216 may be rotationally independent of each other. For example, the rotating member 214 may include a downhole sub 218 that rotates in synch with the collar (e.g., at the drill rig 103 of FIG. 1) and/or the drill bit (e.g., the bit 110 of FIG. 1). In some embodiments, the downhole sub 218 may be a drill pipe (e.g., the drill string 105 of FIG. 1). In other embodiments, the downhole sub 218 may be a downhole tool, or a portion of the BHA (e.g., the BHA 106 of FIG. 1).

The independently rotating member 216 may include an independently rotating platform 220. The independently rotating platform 220 may rotate at a different rotational rate than the downhole sub 218. For example, the independently rotating platform 220 may be a roll stabilized system, such as a roll stabilized control unit of a rotary steerable system. In other examples, the independently rotating platform 220 may be the rotor of a mud motor. In still other examples, the independently rotating platform may be any other downhole element rotationally independent of the downhole sub 218. In further examples, the independently rotating member may be a non-rotating sleeve on a rotary steerable system.

In some examples, the rotating member 214 may rotate with a first rotational rate and the independently rotating platform 220 may rotate with a second rotational rate. In some embodiments, the first rotational rate may be the same as the second rotational rate. In other embodiments, the first rotational rate may be different from the second rotational rate. For example, the second rotational rate may be less than (i.e., with a lower RPM than) the first rotational rate. In some embodiments, the first rotational rate and the second rotational rate may be in the same direction (e.g., clockwise or counterclockwise). In other embodiments, the first rotational rate and the second rotational rate may be in opposite directions (e.g., clockwise or counterclockwise). In some embodiments, the second rotational rate may be zero with respect to an external frame of reference, such as gravity, magnetic north, grid north, true north, or the formation. In other examples, the second rotational rate may be greater than (i.e., with a higher RPM than) the first rotational rate.

In some embodiments, the first rotational rate may be zero or approximately zero. Therefore, the rotating member may not rotate relative to an external frame of reference. The independently rotating member may be driven by a downhole motor, such as a mud motor. In this manner, the independently rotating member may rotate with respect to both the rotating member and an external frame of reference.

The independently rotating platform 220 may be connected to a solenoid 222. The solenoid 222 may be rotationally fixed to the independently rotating platform 220. In other words, the solenoid 222 may rotate with the same rotational rate as the independently rotating platform 220. In some embodiments, the solenoid 222 may be located at the uphole end 224 of the independently rotating platform 220. For example, the independently rotating platform 220 may include an extension 226 that extends uphole past a body of the independently rotating platform (not shown). In other embodiments, the extension 226 may extend downhole from the independently rotating platform 220, and the downhole sub 218 may be downhole of the independently rotating platform 220. The solenoid 222 may be connected to the extension 226 with any type of connection, such as a threaded connection, a reverse-threaded connection, a bolted connection, a weld, a braze, an interference fit, a friction fit, or any other connection.

The rotating member 214 may include a magnetic conductor 228. In some embodiments, the magnetic conductor 228 may be rotationally fixed to the rotating member 214. The magnetic conductor 228 may be rotationally and/or longitudinally movable with respect to or relative to the solenoid 222. The solenoid 222 includes a central bore 230.

In some embodiments, the central bore 230 may have an opening 232 having a non-uniform diameter relative to the rest of the central bore 230. The magnetic conductor 228 may include an end 234 shaped complementarily to the opening 232. In some embodiments, the magnetic conductor 228 may move longitudinally in and out of the opening 232.

In some embodiments, the magnetic conductor 228 may be manufactured from a magnetic material. For example, the magnetic conductor 228 may be manufactured from a steel alloy, a nickel alloy, or another type of magnetic material, such as a rare-earth magnet (e.g., neodymium or samarium alloy magnets).

A gap 236 may be present between the solenoid 222 and the magnetic conductor 228. The gap 236 may maintain a gap distance 237, or an open gap distance, between the solenoid 222 and the magnetic conductor 228 during operation of the solenoid 222. In this manner, the magnetic conductor 228 and the solenoid 222 may not contact. Preventing the solenoid 222 and the magnetic conductor 228 from contacting may reduce the number of physical connections between the rotating member 214 and the independently rotating member 216. This may reduce wear and therefore increase the life of the solenoid 222 and/or the magnetic conductor 228. Furthermore, this may improve reliability of the system, because the solenoid 222 and the magnetic conductor 228 may not get stuck or clog with respect to each other. Still further, this may reduce drag torque on the magnetic conductor 228. In at least one embodiment, the gap 236 may allow for lateral clearance if the downhole connection is bent or curved in a deviated borehole. Furthermore, the gap 236 may allow for thermal expansion and/or protection from contact during vibration or other movement of the solenoid 222 and the magnetic conductor 228 relative to each other.

In some embodiments, the gap 236 may be filled with air, such as standard atmospheric air. Filling the gap 236 with air may reduce the force required to move the magnetic conductor 228 and/or may increase and/or maximize how far the magnetic field is conducted with the magnetic conductor 228. In other embodiments, the gap 236 may be filled with another gas or gas mixture, including an inert gas such as nitrogen. In still other embodiments, the gap 236 may include a vacuum or a near-vacuum. In yet other embodiments, the gap 236 may be filled with a fluid, such as a water based fluid, an oil based fluid, drilling mud, or other fluid. In at least one embodiment, filling the gap 236 with a fluid may help to maintain an operating temperature of the solenoid 222.

In some embodiments, the gap distance 237 may be in a range having an upper value and a lower value, or upper and lower values including any of 0.1 mm, 0.5 mm, 1 mm, 2 mm, 3 mm, 4 mm, 5 mm, 6 mm, 7 mm, 8 mm, 9 mm, 10 mm, or any value therebetween. For example, the gap distance 237 may be greater than 0.1 mm. In other examples, the gap distance 237 may be less than 10 mm. In yet other examples, the gap distance 237 may be any value in a range between 0.1 mm and 10 mm. In at least one embodiment, it may be critical that the gap distance 237 is between 0.1 mm and 10 mm. The gap distance 237 may be sized such that a magnetic flux may flow through the magnetic conductor 228 and such that the magnetic conductor 228 may be magnetically attracted to the solenoid 222 when the solenoid 222 is activated.

The rotating member 214 may include a solenoid housing 238. The solenoid housing 238 may extend around the solenoid 222. In some embodiments, the solenoid housing 238 may extend past a bottom portion 239 of the solenoid 222 and engage the extension 226. The solenoid housing 238 may engage the extension 226 with a rotational connection, such as a bearing including a seal. In this manner, the gap 236 may extend around a portion or all of an outer surface of the solenoid 222, with the solenoid housing 238 sealing the gap to prevent the gas or fluid from escaping. In other words, the gap 236 may be a part of a solenoid chamber 240, which extends around the solenoid and the magnetic conductor 228. In other embodiments, the solenoid housing 238 may engage the solenoid 222 at any location along the outer surface of the solenoid 222.

A moving member 242 (e.g., actuating member) may be a part of an actuation valve 244. The actuation valve 244 may include a flow restrictor 246 and a flow path 248. FIG. 2-1 shows the downhole connection 212 in a first position, with the moving member 242 extended away from the solenoid 222 in a moving member first position. In the first position, the flow restrictor 246 blocks the entrance 250 to the flow path 248. In this manner, a fluid flow into the flow path 248 is reduced or stopped when the downhole connection 212 is in the first position. In some embodiments, the magnetic conductor 228 may move relative to the solenoid 222 with the moving member 242. In some embodiments, the moving member 242 and a portion of the flow restrictor shaft 246 may be contained within a pressure housing that isolates the moveable member from the pressure at 248.

In the position shown in FIG. 2-1, there is an actuator gap 241 between the magnetic conductor 228 and the moving member 242. In some embodiments, the actuator gap 241 may be in a range having an upper value and a lower value, or upper and lower values including any of 0.1 mm, 0.5 mm, 1 mm, 2 mm, 3 mm, 4 mm, 5 mm, 6 mm, 7 mm, 8 mm, 9 mm, 10 mm, or any value therebetween. For example, the actuator gap 241 may be greater than 0.1 mm. In other examples, the actuator gap 241 may be less than 10 mm. In yet other examples, the actuator gap 241 may be any value in a range between 0.1 mm and 10 mm. In at least one embodiment, it may be critical that the actuator gap 241 is between 0.1 mm and 10 mm. The actuator gap 241 may be sized such that a magnetic flux may flow through the magnetic conductor 228 and such that the magnetic conductor 228 may be magnetically attracted to the solenoid 222 when the solenoid 222 is activated.

FIG. 2-2 shows the downhole connection 212 in a second position, with the moving member 242 in the moving member second position. In the moving member second position, the moving member 242 may be located in the opening 232 such that it is closer to the solenoid 222 than in the moving member first position (i.e., closer to the extension 226 of the independently rotating platform 220, or to a downhole end 251 of the solenoid 222).

Because the magnetic conductor 228 does not move during actuation of the solenoid, the gap 236 may be remain the same or approximately the same between the magnetic conductor 228 and the solenoid 222 in the moving member second position as in the moving member first position. Thus, the magnetic conductor 228 and the solenoid 222 may not contact when the moving member 242 is in the moving member second first position or the moving member second position. In other words, the magnetic conductor 228 and the solenoid 222 may not come into physical or mechanical contact in the first position of the downhole connection 212 or the second position of the downhole connection 212. In this manner, there may always be a non-zero distance between the magnetic conductor 228 and the solenoid 222.

As previously discussed, the magnetic conductor 228 may remain fixed relative to the solenoid 222, meaning that as the solenoid 222 is activated, the magnetic conductor 228 may not move, and the gap distance 237 may be the same as the second gap distance 237-2. The moving member 242 may have a second gap between the moving member 242 and the magnetic conductor 228. The moving member 242 may be magnetically attracted to the magnetic field of the activated solenoid 222. Thus, when the solenoid 222 is activated, the moving member 242 may move toward the solenoid 222, while the magnetic conductor 228 remains at a fixed distance relative to the solenoid 222. In some embodiments, when the moving member 242 is moved toward the magnetic conductor 228, the second gap may be completely closed, or, in other words, the moving member 242 may contact the magnetic conductor 228 when the solenoid 222 is activated. In some embodiments, the moving member 242 may move approximately ⅓ or greater of a diameter of the diameter of the actuation valve 244.

As discussed above, the gap 236 may reduce the number of rotational connections between the rotating member 214 and the independently rotating member 216. This may reduce the complexity of the BHA (e.g., BHA 106 of FIG. 1), reduce wear on components of the downhole connection 212, and reduce the cost of the BHA. In some embodiments, the gap 236 may make the downhole connection 212 a frictionless or a low-friction connection because contact points between the rotating member 214 and the independently rotating member 216 are limited.

Moving the moving member 242 toward the solenoid 222 may remove the flow restrictor 246 from the entrance 250 of the flow path 248. This may allow fluid to enter the flow path 248. In this manner, the actuation valve 244 may be opened in the downhole connection 212 second position, or when the moving member 242 is in the moving member second position. Similarly, the actuation valve 244 may be closed in the downhole connection 212 first position (e.g., the position depicted in FIG. 2-1), or when the moving member 242 is in the moving member first position (as shown in FIG. 2-1).

In some embodiments, the solenoid 222 may be deactivated when the downhole connection 212 is in the first position. Thus, when the solenoid 222 is activated, the moving member 242 may be drawn toward the solenoid 222. This may remove the flow restrictor 246 from the entrance 250 of the flow path 248. In this manner, the solenoid 222 is activated when the downhole connection 212 is in the second position. Thus, activating the solenoid 222 may actuate the moving member 242, which may actuate or open the actuation valve 244.

After the solenoid 222 is deactivated, a resilient member (not shown) may provide a return force to move or urge the moving member 242 back from the moving member second position to the moving member first position. The resilient member may include a hydraulic or pneumatic piston, a coil spring, a wave spring, a Belleville washer, or the like. Therefore, by activating and deactivating the solenoid 222, the actuation valve 244 may be activated and de-activated. In this case, the standard, or unpowered, position of the downhole connection 212 may be the first position, or with the actuation valve 244 closed.

In other embodiments, the solenoid 222 may be deactivated when the downhole connection 212 is in the second position. Thus, when the solenoid 222 is activated, the moving member 242 may be repelled from the solenoid 222. This may move the moving member 242, thereby inserting the flow restrictor 246 into the entrance 250 of the flow path 248. In this manner, the solenoid 222 is activated when the downhole connection 212 is in the first position.

After the solenoid 222 is deactivated, a resilient member (not shown) may provide a return force to move or urge the moving member 242 back from the moving member first position to the moving member second position. The resilient member may include a hydraulic or pneumatic piston, a spring, a Belleville washer, or the like. Therefore, by activating and deactivating the solenoid 222, the actuation valve 244 may be activated and de-activated. In this case, the standard, or unpowered, position of the downhole connection 212 may be the second position, or with the actuation valve 244 open.

In some embodiments, hydraulic pressure from the actuation valve 244 may provide the return force to return the moving member 242 from the moving member first position to the moving member second position or from the moving member second position to the moving member first position. In this case, the magnetic field provided by the solenoid 222 attracts or repels the moving member 242 with sufficient force to overcome the hydraulic pressure.

In some embodiments, the moving member 242 may have a stroke length, which may be the difference in longitudinal length between the moving member first position and the moving member second position. In other words, the stroke length may be the difference between the actuator gap (e.g., actuator gap 241 of FIG. 2-1) and the second gap distance (e.g., no gap as shown in FIG. 2-2). In some embodiments, the stroke length may be the minimum necessary to open and close the actuation valve 244. In some embodiments, the stroke length may be in a range having an upper value and a lower value, or upper and lower values including any of 1 mm, 2 mm, 3 mm, 4 mm, 5 mm, 6 mm, 7 mm, 8 mm, 9 mm, 10 mm, 12 mm, 14 mm, 16 mm, or any value therebetween. For example, the stroke length may be greater than 3 mm. In other examples, the stroke length may be less than 20 mm. In yet other examples, stroke length may be any value in a range between 1 mm and 10 mm, or in a range between 1.5 mm and 4 mm. In some embodiments, the stroke length may be ⅓ or greater of a diameter of the actuation valve 244.

By selectively activating and deactivating the solenoid 222, the independently rotating platform 220 may communicate information from the independently rotating member 216 to the rotating member 214. This information may be encoded into a pattern represented by controlling the length of time during which the solenoid 222 is activated and deactivated, the frequency of the activations and deactivations, or any known communication pattern. As discussed above, activating and deactivating the solenoid 222 may cause the moving member 242 to move from the moving member first position to the moving member second position. In some embodiments, a sensor connected to the rotating member 214 may sense the movement of the moving member 242. A control unit, or a computing system, may then decode the information from the pattern of movement of the moving member 242. In some embodiments, a signal between the independently rotating member 216 and the rotating member 214 may be transmitted as fast as the moving member 242 may be actuated and de-actuated.

In other embodiments, the actuation valve 244 may activate a downhole tool, which may facilitate communication with other portions of the wellbore and/or the surface. For example, the downhole tool may be mud pulse telemetry system, and the actuation valve 244 may activate mud pulses in the mud pulse telemetry system. In some embodiments, sensors sensing the movement of the actuation member and the actuation valve 244 may to communicate information from the independently rotating member 216 to the rotating member 214.

Figure 3:
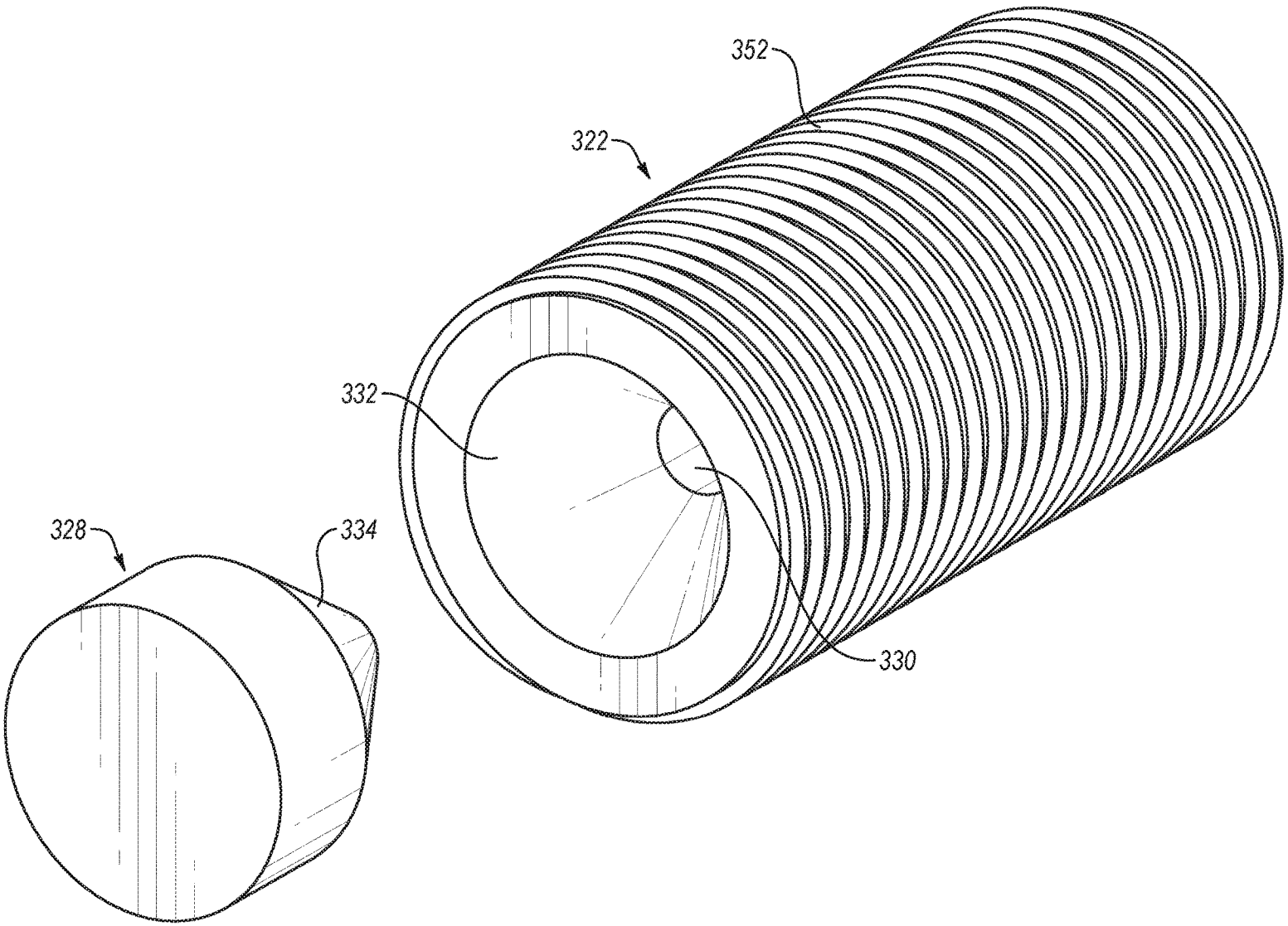
FIG. 3 is a perspective view of a downhole connection, according to at least one embodiment of the present disclosure.

FIG. 3 is a perspective view of a solenoid 322 and magnetic conductor 328, according to at least one embodiment of the present disclosure. The solenoid 322 may have a coil 352 wrapped a number of wraps around the solenoid 322. As is well known, the number of wraps of the coil 352, in combination with a diameter of the solenoid 322, a length of the solenoid, and an amount of current passed through the coil 352, may influence the amount of magnetic flux through a central bore 330 of the solenoid 322. In some embodiments, when the magnetic conductor 328 is fixed in place (e.g., does not move longitudinally relative to the solenoid 322), the magnetic conductor 328 may further conduct the magnetic flux generated by the solenoid 322, extending the magnetic flux outward to the moving member (e.g., moving member 242 of FIG. 2-1).

The central bore 330 may include an opening 332. In some embodiments, the opening 332 may have a larger diameter than the central bore 330. The magnetic conductor 328 may have an end 334 that is complementarily shaped to the opening 332. In some embodiments, the opening 332 and the end 334 may have a generally conical or frustoconical shape.

Figures 3, 4:
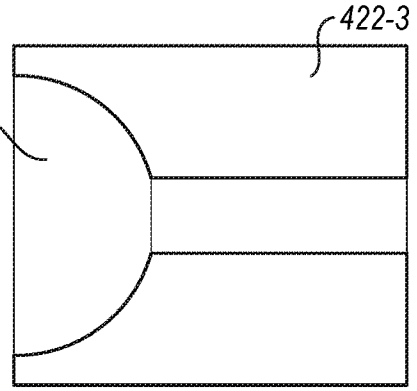
Figures 2, 4:
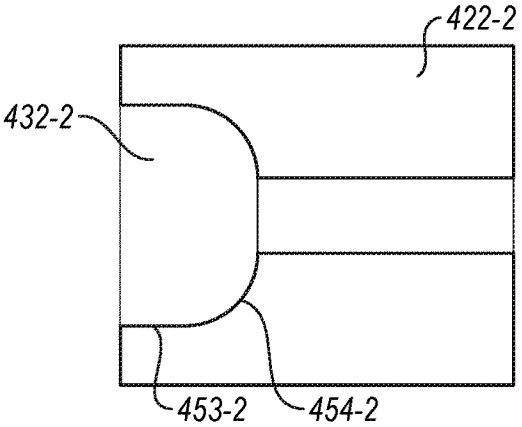
Figures 1, 4:
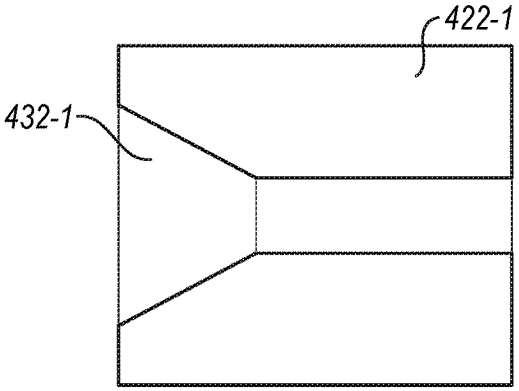
Figures 4, 5:
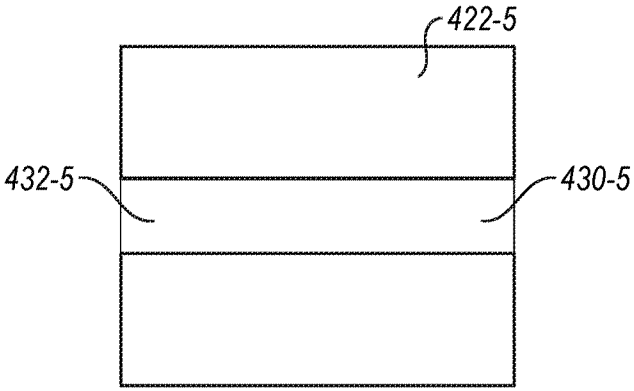
Figure 4:
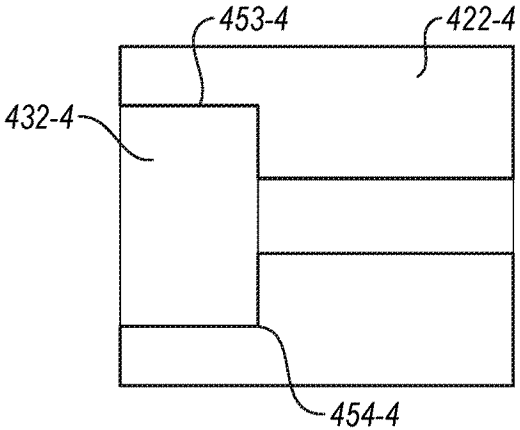
Figures 1, 5:
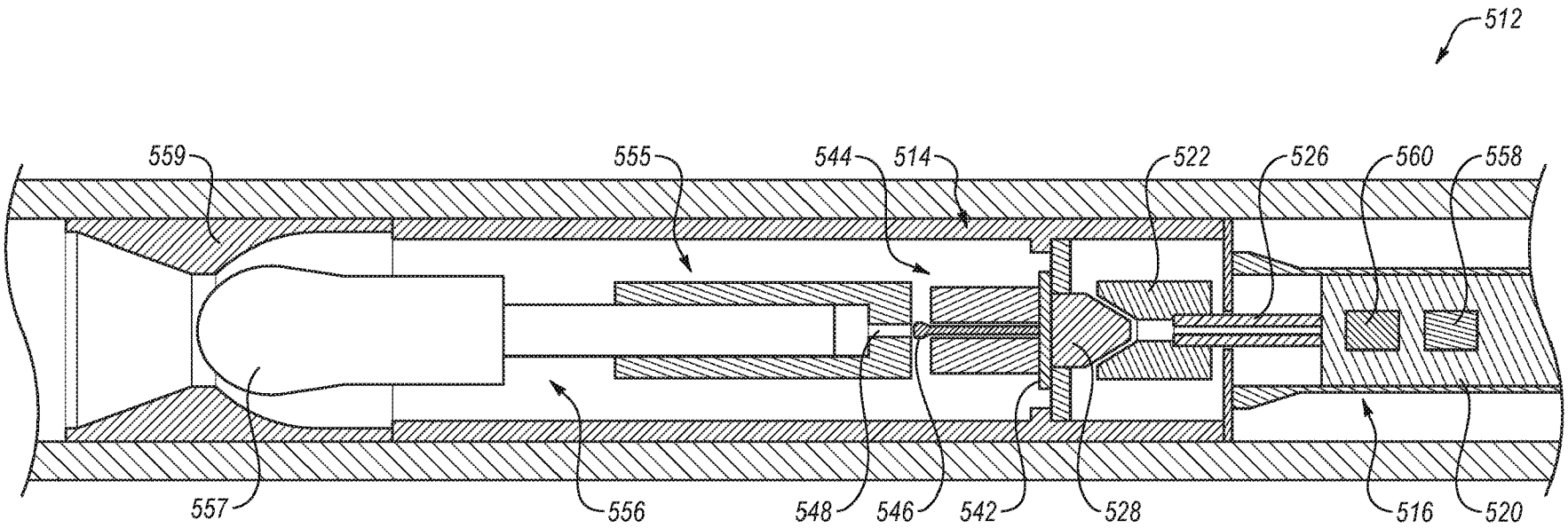
Figures 2, 5:
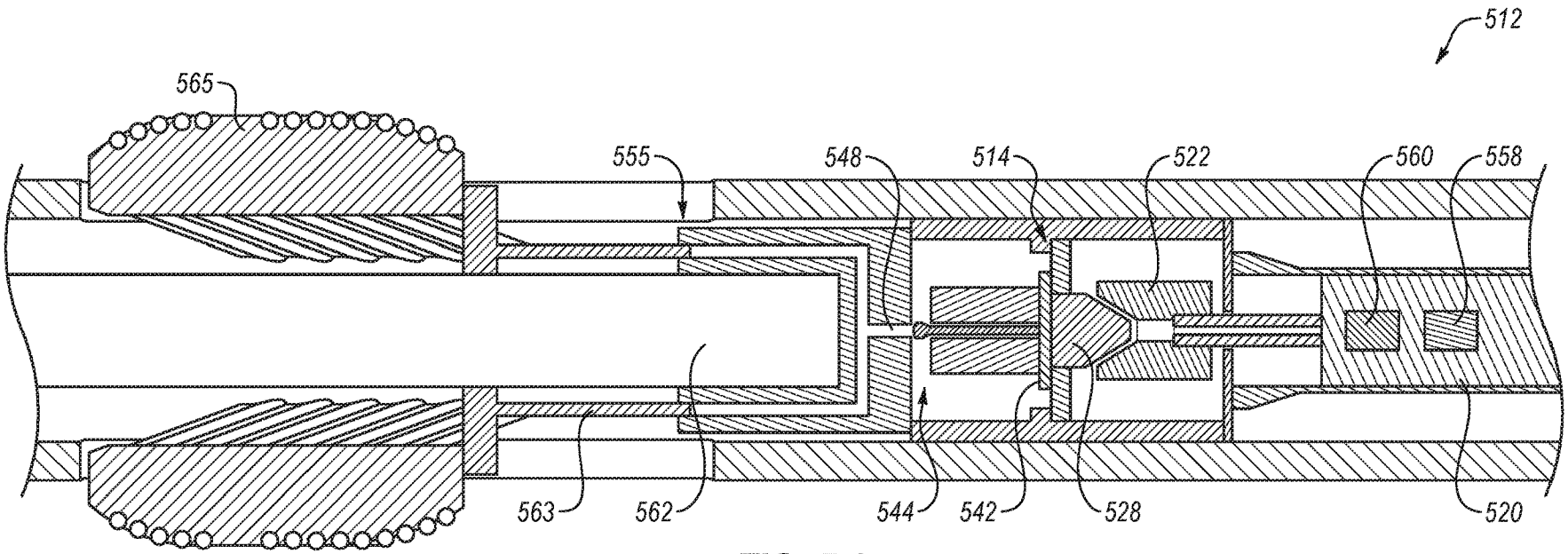

FIG. 4-1 through FIG. 4-5 are cross-sectional views of embodiments of a solenoid (collectively solenoids 422) having different shapes of openings (collectively openings 432). The openings 432 may be any two-dimensional shape rotated about 360° of axis. In other words, the openings 432 may be any conical, spherical, hemispherical, domed, and/or cylindrical shape. For example, FIG. 4-1 shows a solenoid 422-1 having an opening 432-1 with a generally triangular shape. In three dimensions, the opening 432-1 may be conical or frustoconical.

In other examples, FIG. 4-2 shows a solenoid 422-2 having straight sides 453-2 and a domed end 454-2. In three dimensions, the opening 432-2 may be a domed cylinder or a dome. FIG. 4-3 shows a solenoid 422-3 having a half-circular opening 432-3. In three dimensions, the opening 432-3 may be hemispherical. FIG. 4-4 shows a solenoid 422-4 having a rectangular opening 432-4, with straight sides 453-4 and square ends 454-4. In three dimensions, the opening 432-4 may be cylindrical. FIG. 4-5 shows a solenoid 422-5 having an opening 432-5 that is the same diameter as a central bore 430-5.

In some embodiments, each of these solenoids 422 may be paired with a magnetic conductor(e.g., magnetic conductor 228 of FIG. 2-1) having an end (e.g., end 234 of FIG. 2-1) complementarily shaped to the respective opening 432. However, in other embodiments, a solenoid 422 may be paired with an actuation member having an end that is not complementarily shaped to the respective opening. For example, a frustoconical opening 432 may be paired with a cylindrical end. In other examples, a hemispherical opening 432 may be paired with a frustoconical end. In yet other examples, a cylindrical opening 432 may be paired with a domed end.

FIG. 5-1 is a representation of an embodiment of a downhole connection 512. In some embodiments, the downhole connection 512 may include a rotating member 514 and an independently rotating member 516. The rotating member 514 may include a downhole tool 555. The independently rotating member 516 may include an independently rotating platform 520. An extension 526 from the uphole end of the independently rotating platform 520 may be connected to a solenoid 522. A magnetic conductor 528 may be offset from the solenoid 522. A moving member 542 may be connected to an actuation valve 544, the actuation valve including a flow restrictor 546 that may restrict flow to a flow path 548 based on the position of the magnetic conductor 528.

In some embodiments, the independently rotating platform 520 may include a measuring while drilling (MWD) module or tool, a logging while drilling (LWD) module or tool, a roll stabilized platform, a rotary steerable system (e.g., a rotary steerable control unit), or any combination of the foregoing. The independently rotating platform 520 may include a control unit 560. The control unit 560 may be in electronic communication with the solenoid 522. The control unit 560 may control the activation of the solenoid 522. In other words, the control unit 560 may direct electric current to the solenoid 522 to activate or deactivate the solenoid 522.

The control unit 560 may encode data into a pattern and activate or deactivate the solenoid 522 in the pattern. Therefore, the control unit 560 may communicate or transmit information from the independently rotating member 516 to the rotating member 514 by activating and deactivating the solenoid 522 in the pattern, the pattern including the encoded data.

The downhole tool 555 may receive the pattern including encoded data and decode the data. For example, the encoded data may be an instruction for the downhole tool 555 to change a drilling parameter of the downhole tool 555. In some embodiments, the downhole tool may include any downhole tool known in the art, such as an expandable mill, an expandable reamer, an expandable stabilizer, another expandable tool, an MWD, an LWD, and the like. In some embodiments, the downhole tool may include a mud pulse generator 566.

As the solenoid 522 is activated and/or deactivated, the actuation valve 544 may be opened and/or closed. The flow path 548 may be in fluid communication with the mud pulse generator 556. When the actuation valve 544 is open, fluid may flow through the flow path 548, which may actuate the mud pulse generator 566.

In some embodiments, a flow restrictor 557 in the mud pulse generator 556 has a high pressure position and a low pressure position. When the flow restrictor 557 is in the high pressure position, drilling fluid flowing through the mud pulse generator 556 is restricted, which increases the hydraulic pressure of the drilling fluid. When the flow restrictor 557 is in the low pressure position, drilling fluid flowing through the mud pulse generator 556 is relatively unrestricted, which decreases the hydraulic pressure of the drilling fluid. Therefore, by changing the flow restrictor 557 between the high pressure position and the low pressure position, the hydraulic pressure of the drilling fluid may be changed, which may result in a "pressure pulse." It should be understood that the mud pulse generator 556 shown in FIG. 5-1 is simply one sample embodiment of a mud-pulse generator. Other mud pulse generators (e.g., a siren type mud-pulse generator), using flow restrictors 557 having different shapes and/or located in different positions (such as in the wall 559) may also be used in embodiments of the present disclosure.

When the actuation valve 544 is open, fluid flowing through the flow path 548 may actuate the mud pulse generator 556, changing the flow restrictor 557 from the low pressure position to the high pressure position. Similarly, when the actuation valve 544 is closed, the mud pulse generator 556 may be de-actuated, and the flow restrictor 557 may change from the high pressure position to the low pressure position. Therefore, when the solenoid 522 is activated, the mud pulse generator 556 may increase the pressure of the drilling fluid, and when the solenoid 522 is deactivated, the mud pulse generator 556 may decrease the pressure of the drilling fluid. Thus, pressure pulses may be generated by activating and deactivating the solenoid 522. Because the actuation valve 544 actuates and de-actuates the mud pulse generator 556, the actuation valve 544 may be a pilot valve for the mud pulse generator 556.

In some embodiments, the power to actuate the solenoid 522 is located on the independently rotating platform 520. Because the actuation valve 544 may be a pilot valve for the mud pulse generator 556, the mud pulse generator 556 may not need an independent power source. Therefore, the mud pulse generator 556 may be completely mechanical, or completely hydraulically operated, without an electronic control unit. In some embodiments, the mud pulse generator 556 may have no other actuation mechanism and may be actuated only by the actuation valve 544. In other embodiments, a sensor on the rotating member 514 may sense the actuation and de-actuation of the moving member 542, and an electronic control unit on the mud pulse generator 556 may actuate the mud pulse generator.

In this manner, the control unit 560 may communicate information and/or data from the independently rotating member 516 to any location that is capable of receiving and receiving pressure pulses and interpreting the encoded data. In some embodiments, the control unit 560 may communicate information and/or data from the independently rotating member 516 to a pressure pulse receiver located at a surface location. In the same or other embodiments, the control unit 560 may communicate information and/or data from the independently rotating member 516 to a pressure pulse receiver located at a downhole tool, such as the downhole tool 555. Thus, the control unit 560 may communicate information over relatively short ranges (e.g., 0-50 feet) up to and including relatively long ranges (e.g., the entire length of the borehole or over 8,000 feet).

In at least one embodiment, the independently rotating platform 520 may include at least one sensor 558 in electronic communication with the control unit 560. The at least one sensor 558 may be located on an MWD or an LWD tool, or the at least one sensor 558 may be located on another aspect of the independently rotating platform. The at least one sensor 558 may include any type of sensor, such as a directional sensor (e.g., azimuth and/or inclination), a gravimetric sensor, a gamma ray sensor, an accelerometer, a gyroscope, a resistivity sensor, a tool status sensor, (e.g., strain gauge or resistivity array) or any other sensor.

The at least one sensor 558 may take a measurement. The control unit 560 may then encode the measurement into a pattern and activate the solenoid 522 in the pattern. In this manner, a measurement taken on the independently rotating platform 520 may be communicated to the downhole tool 555. In some embodiments, the downhole tool 555 may be the mud pulse generator 556. The mud pulse generator 556 may then transmit the measurement as mud pulses in the pattern. Thus, the measurement may be communicated to any location that can receive and decode mud pulses with a mud pulse receiver.

In some embodiments, the control unit 560 may control actuation of the mud pulse generator 556 based on a set of predetermined drilling conditions, such as wellbore depth, inclination, formation characteristics, and so forth. In some embodiments, the sensor 558 may take a measurement, and, based at least in part on the measurement, the control unit 560 may actuate or de-actuate the actuation valve 544 and therefore the mud pulse generator 556.

In other embodiments, the downhole tool 555 may be an MWD. The independently rotating platform 520 may be located closer to the bit (e.g., the bit 110 of FIG. 1) than the MWD. Measurements taken closer to the bit may be more representative of actual drilling conditions and/or drill bit conditions than measurement taken further from the bit. For example, a measurement taken closer to the bit may measure characteristics about the formation near the bit. Therefore, a drilling system or an operator may react more quickly to changing drilling conditions, thereby saving wear and tear on drilling equipment and/or improving penetration rate. Similarly, a drilling azimuth or inclination measured closer to the bit is likely more representative of the immediate path being taken by the bit, and therefore a drilling system or an operator may make changes to the drilling path quickly based on measurements taken close to the bit. Therefore, measuring data at the independently rotating platform and communicating it may improve drilling accuracy, penetration rate, and/or save costs on equipment maintenance.

In this manner, providing information to an MWD that is not located on the independently rotating platform 520 may allow the MWD process the information. After processing, the MWD may either communicate the information to another location, such as another downhole tool, or to the surface. In the same or other embodiments, the MWD may perform other tasks. For example, the MWD may cause an expandable tool to expand or retract expandable blades based on the information provided from the independently rotating platform 520. In other examples, the MWD may cause a second sensor (not located on the independently rotating platform) to take a second measurement.

FIG. 5-2 is another representation of the downhole connection 512, according to at least one embodiment of the present disclosure. In some embodiments, the rotating member 514 may include an expandable tool 562. The control unit 560 may be in electronic communication with the solenoid 522 and control the activation of the solenoid 522.

As the solenoid 522 is activated and/or deactivated, the actuation valve 544 may be opened and/or closed. The flow path 548 may be in fluid communication with the expandable tool 562. For example, in the embodiment shown in FIG. 5-2, when the actuation valve 544 is open, fluid may flow through the flow path 548, which may actuate the expandable tool 562. For example, actuating the expandable tool 562 may include pressurizing a piston 563 which may push expandable blades 565 radially outward from the expandable tool 562. Closing the actuation valve 544, or deactivating the solenoid 522, may depressurize the piston 563, which may cause the expandable blades 565 to move radially inward. Therefore, the actuation valve 544 may be a pilot valve for the expandable tool 562. However, it should be appreciated that different mechanisms to actuate an expandable tool 562 may be used in conjunction with the embodiments of this disclosure. For example, a sensor may sense the movement of the moving member 542, and a control unit on the rotating member 514 may decode information encoded into the pattern of movements of the moving member 542. Based on that information, the control unit on the rotating member 514 may actuate or de-actuate the expandable tool 562.

In some embodiments, the expandable tool 562 may be an underreamer, a stabilizer, a mill, or any other type of expandable tool. Because the control unit 560 controls the actuation of the actuation valve 544, the control unit 560 therefore may have control over the actuation of the expandable tool 562. In some embodiments, the control unit 560 may control the actuation of the expandable tool 562 based on a set of predetermined drilling conditions, such as wellbore depth, inclination, formation characteristics, and so forth. In some embodiments, the sensor 558 may take a measurement, and, based at least in part on the measurement, the control unit 560 may actuate or de-actuate the actuation valve 544 and therefore the expandable tool 562.

Figure 6:
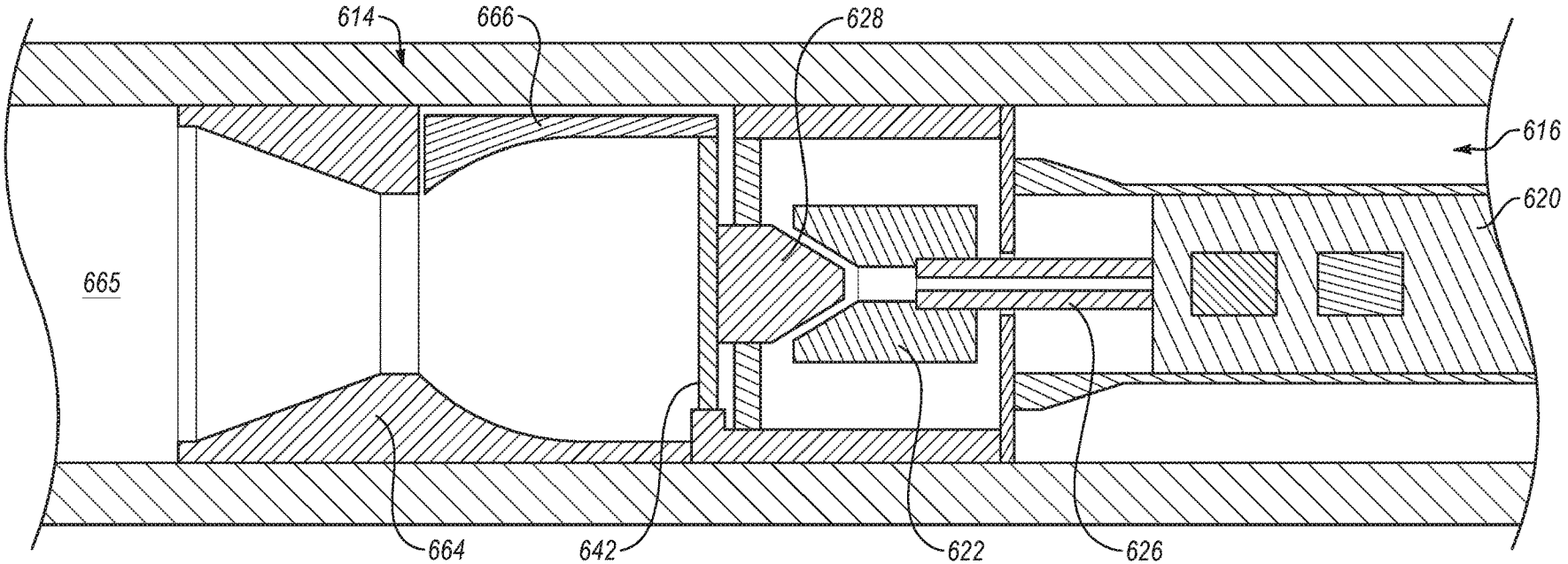
FIG. 6 is yet another cross-sectional view of a downhole connection, according to at least one embodiment of the present disclosure.

FIG. 6 is a representation of an embodiment of a downhole connection 612. In some embodiments, the downhole connection 612 may include a rotating member 614 and an independently rotating member 616. The rotating member 614 may include a downhole tool. The independently rotating member 616 may include an independently rotating platform 620. An extension 626 from the uphole end of the independently rotating platform 620 may be connected to a solenoid 622. A magnetic conductor 628 may be offset from the solenoid 622. As the solenoid 622 is activated and deactivated, the moving member 642 may move closer to and further from the solenoid 622.

The rotating member 614 may include a Venturi constriction 664. The Venturi constriction 664 may create a change in pressure of a drilling fluid passing through a central bore 665 of the downhole connection 612. A flow adjustment member 666 may be connected to the moving member 642 opposite the magnetic conductor 628. Therefore, the flow adjustment member 666 may move as the moving member 642 moves based on the activation and deactivation of the solenoid 622.

As the flow adjustment member 666 moves, the flow through the Venturi constriction 664 may change. This in turn may change the pressure of the drilling fluid that flows through the central bore 665. In this manner, by activating and deactivating the solenoid 622, a pressure pulse may be generated in the drilling fluid. Therefore, rather than the solenoid 622 and the moving member 642 actuating an actuation valve (such as actuation valve 544 of FIG. 5-1) or a pilot valve, the solenoid 622 and the moving member 642 may be a part of a mud pulse generator. In other words, the activation and deactivation of the solenoid 622 may directly generate pressure pulses in the drilling fluid by moving the moving member 642 between a first and a second moving member position. For example, moving the moving member 642 between the first and the second moving member position may move the flow adjustment member 666 between a first and a second flow adjustment position, thereby changing the flow of drilling fluid through the Venturi constriction 664 and changing the pressure of the drilling fluid. Including the solenoid 622, the magnetic conductor 628, and the moving member 642 in the mud pulse generator to transmit information across a rotating connection may decrease the complexity of a mud pulse telemetry system. This may improve reliability and reduce the overall costs of a borehole.

Figures 1, 7:
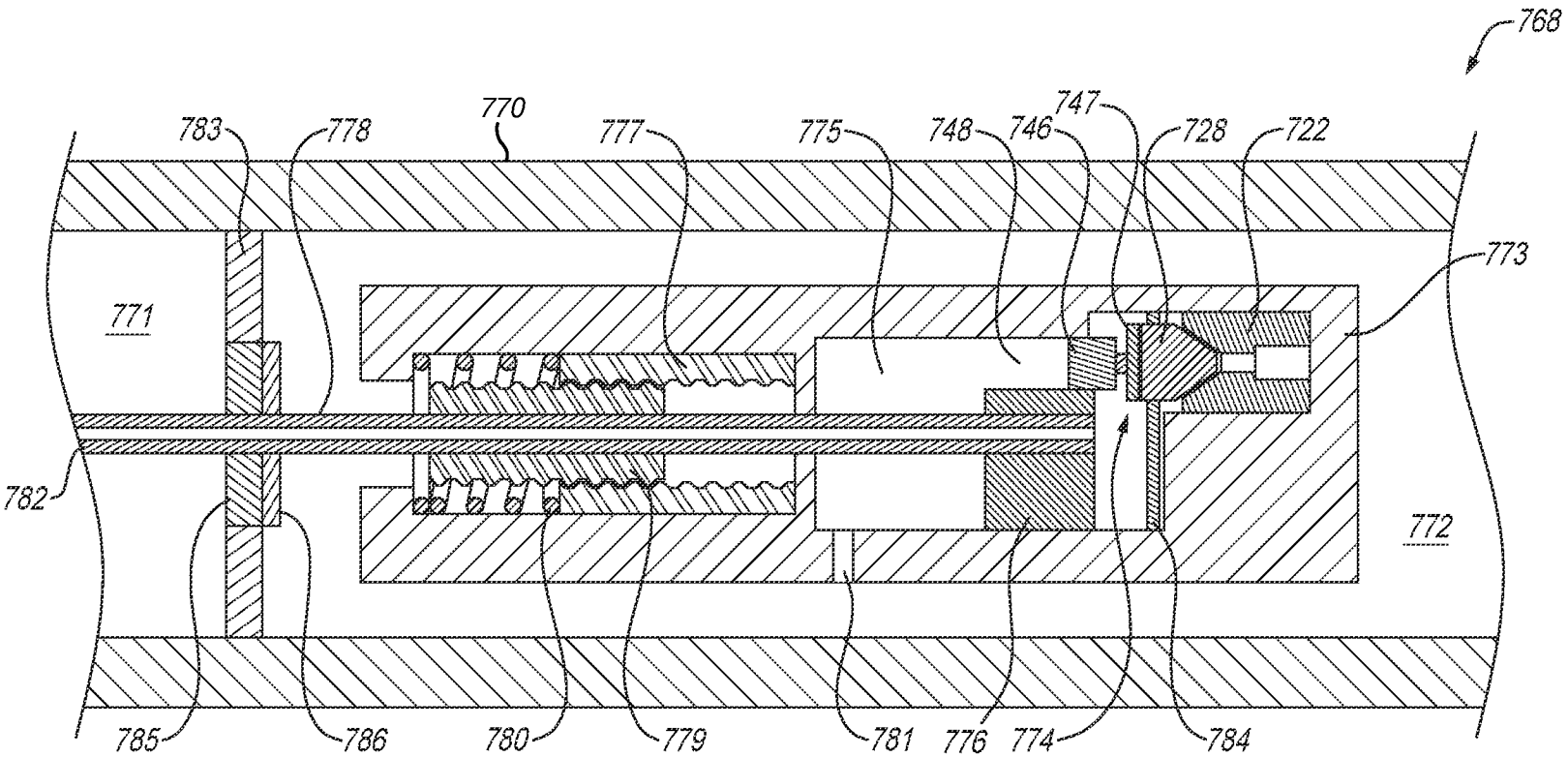
Figures 2, 7:
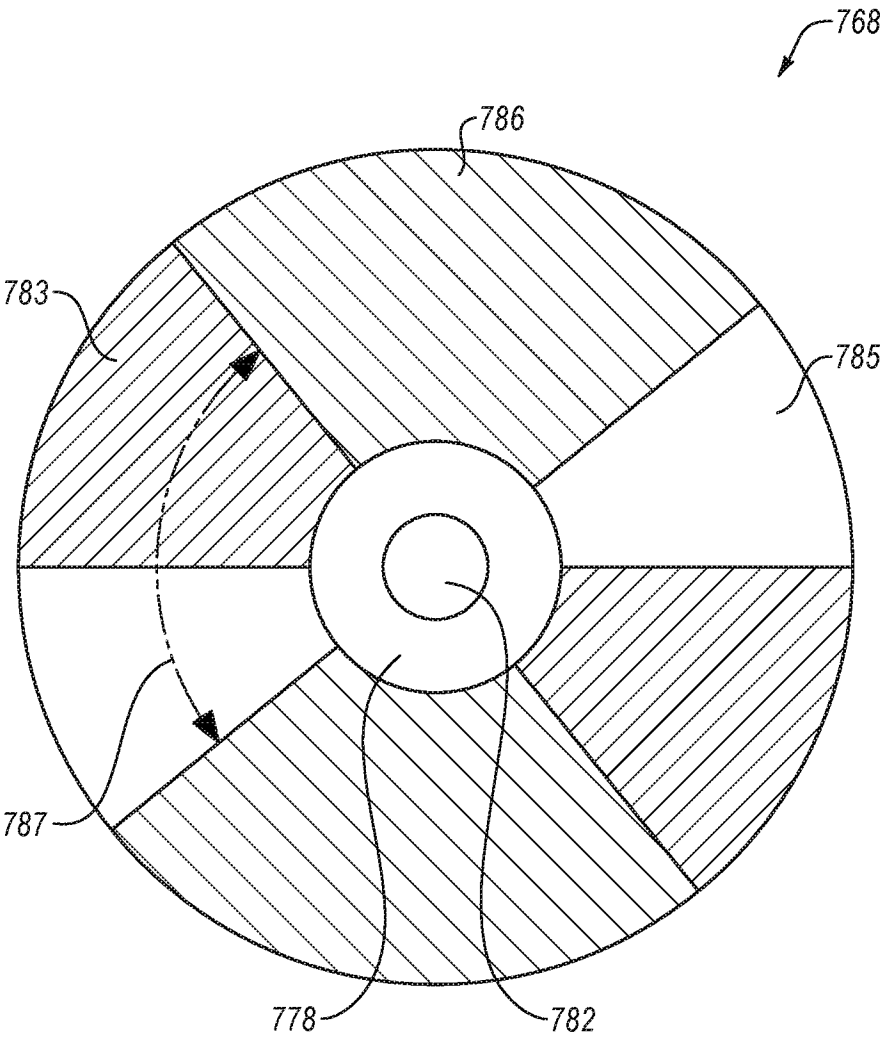

FIG. 7-1 is a representation of a mud pulse telemetry system 768, according to at least one embodiment of the present disclosure. The mud pulse telemetry system 768 may include a housing 770 having a high pressure side 771 and a low pressure side 772. The housing may enclose an actuation valve 774. In some embodiments, the actuation valve 774 may be similar to the downhole connection 212 of FIG. 2-1, and may include similar features and elements, such as a rotating to non-rotating connection.

In some embodiments, the actuation valve 774 may be located in a valve housing 773. The valve housing 773 may include a solenoid 722, a magnetic conductor 728, and a moveable member 747. The actuation valve 774 may include a flow restrictor 746. As the solenoid 722 is activated and deactivated, the moveable member 747 and the flow restrictor 746 may move longitudinally back and forth relative to the solenoid 722. In a first moveable member position, which may be located further away from the solenoid, the flow restrictor 746 may partially or fully block the flow of a fluid through a flow path 748. In the second movable member position, which may be located closer to the solenoid, the flow restrictor 746 may allow the flow of the fluid through the flow path 748. Fluid flowing through the flow path may enter a piston chamber 775. Fluid pressure from the fluid in the piston chamber 775 may push on a piston 776, causing the piston 776 to move longitudinally from a first piston position to a second piston position. In some embodiments, the piston 776 may be cylindrical, or a cylindrical piston.

An interior surface of the piston 776 may include piston threads 777. A rotor shaft 778 may extend through the center of the piston 776. At least a portion of an exterior of the rotor shaft 778 may include rotor threads 779. The rotor threads 779 and the piston threads 777 may be complementary and engage on the interior surface of the piston 776. The piston may be rotationally fixed relative to the valve housing 773. Therefore, as the piston 776 moves in response to fluid pressure in the piston chamber 775, the piston threads 777 engage the rotor threads 779, thereby rotating the rotor shaft 778.

By using a known pitch of piston threads 777 and rotor threads 779, the amount of rotation of the rotor shaft 778 may be controlled by limiting the actuation length of the piston 776. In this manner, the rotor shaft 778 may be rotated by a desired rotor angle. The rotor angle may include any angle between 0° and 360°. For example, the rotor angle may be 90°. In other examples, the rotor angle may be 45°. In still other examples, the rotor angle may be 60°. In yet other examples, the rotor angle may be 120°.

A resilient member 780 may provide a return force to return the piston 776 from the second piston position to the first piston position. When the actuation valve 774 is open (i.e., when the flow restrictor 746 is not restricting flow through the flow path 748), the fluid pressure in the piston chamber 775 may be greater than the return force of the resilient member 780, thereby moving the piston 776 from the first piston position to the second piston position. When the actuation valve 774 is closed (i.e., when the flow restrictor 746 is restricting flow through the flow path 748), the return force may be greater than the fluid pressure in the piston chamber 775, thereby moving the piston 776 from the second piston position to the first piston position. Fluid inside the piston chamber 775 may exhaust through the exhaust port 781.

Therefore, by actuating the valve 774, the rotor shaft 778 may be rotated in a first direction by the rotor angle from a first rotor position to a second rotor position, and by de-actuating the valve 774, the rotor shaft 778 may be rotated in a second direction, opposite from the first direction, by the rotor angle from the second rotor position to the first rotor position. Thus, the rotor shaft 778 may move back and forth between the first rotor position and the second rotor position, the first and second rotor positions being separated by the rotor angle, based on the actuation of the actuation valve 774 and the solenoid 722.

The rotor shaft 778 may include a fluid conduit 782. The fluid conduit 782 may be open to the high pressure side 771. The fluid conduit 782 may pass through a partition 783 separating the high pressure side from the low pressure side. The fluid conduit may open into a valve chamber 784, the valve chamber 784 being in fluid communication with the piston chamber 775 through the flow path 748. Thus, when the actuation valve 774 is open, fluid from the high pressure side 771 may travel through the fluid conduit 782 to the valve chamber 784, and, when open, through the flow path 748 to the piston chamber 775, and finally out the exhaust port 781 to the low pressure side 772. The pressure to move the piston 776 is provided by the pressure differential from the high pressure side 771 to the low pressure side 772.

The partition 783 may include one or more ports 785. The one or more ports 785 may be fully or partially blocked or occluded by one or more rotor paddles 786. The one or more rotor paddles 786 may be rotationally fixed relative to the rotor shaft 778. As the rotor shaft 778 is rotated by actuation of the solenoid 722 and the actuation valve 774, the rotor paddles 786 may rotate as well. As the rotor paddles 786 rotate in a first direction, one or more of the one or more ports 785 may be unblocked, thereby allowing fluid to travel from the high pressure side 771 to the low pressure side 772. This may decrease the pressure on the high pressure side 771, and increase the pressure on the low pressure side 772. In this manner, by selectively actuating and de-actuating the actuation valve 774 and the solenoid 722, a pressure pulse may be generated.

FIG. 7-2 is a cross sectional view of the mud telemetry system 768 of FIG. 7-1 taken above the partition 783. As described above, one or more rotor paddles 786 may be connected to the rotor shaft 778, and a fluid conduit 782 may pass through the center of the rotor shaft 778. In the embodiment shown, as the rotor paddles 786 are rotated counterclockwise, the one or more ports 785 may become more occluded and even be blocked completely. In other words, the rotor opening may be misaligned with the one or more ports 785. Conversely, as the rotor paddles 786 are rotated clockwise, the one or more ports 785 may become less occluded and even be completely exposed or uncovered. In other words, the rotor opening and the port may be at least partially aligned such that fluid may pass through the combined opening of the rotor opening and the port. In the embodiment shown, the angle 787 between two rotor paddles 786 may be the same as or close to the same as the rotor angle. In other embodiments, the angle 787 between two rotor paddles 786 may be greater than or less than the rotor angle. By adjusting the rotor angle, the amplitude of a pressure pulse may be adjusted. However, it should be understood that the rotor paddles 786 may be rotated clockwise to occlude the one or more ports 785 and counterclockwise to expose the one or more ports 785.

Figure 8:
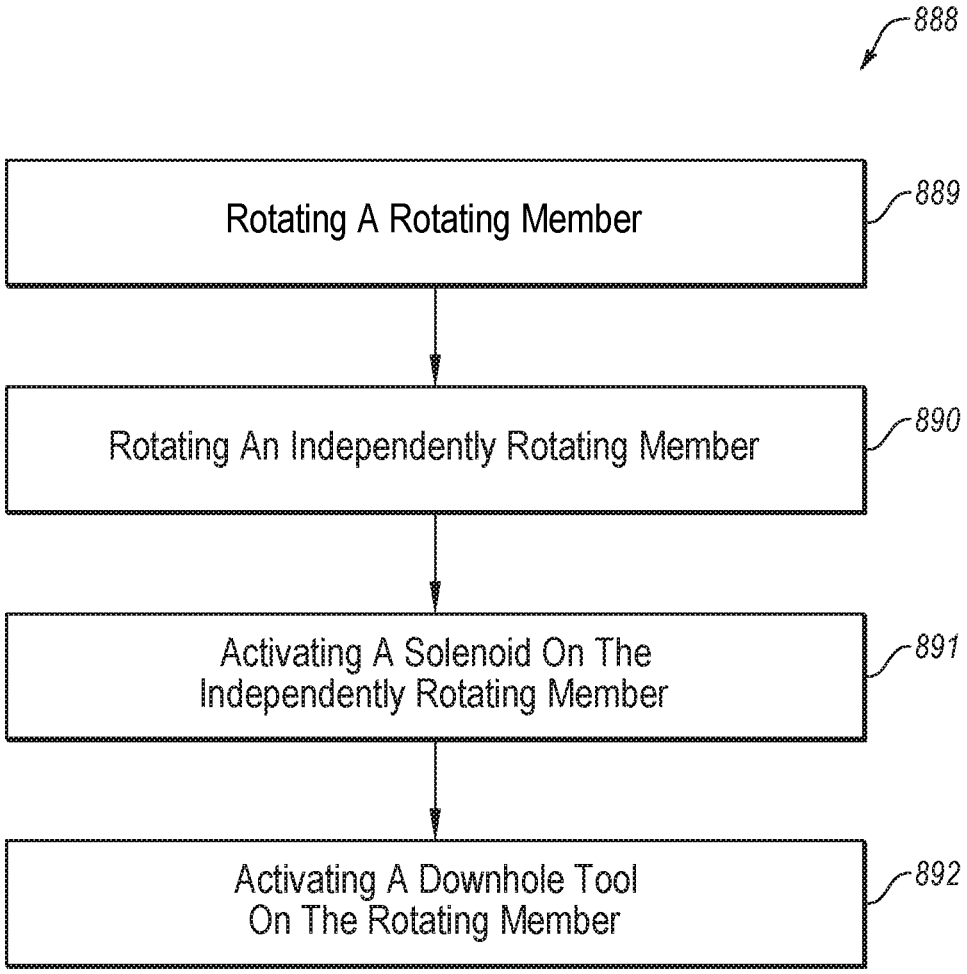
FIG. 8 depicts a method for operating a downhole connection, according to at least one embodiment of the present disclosure.

FIG. 8 is a method chart of a method 888 for operating a downhole connection. The method 888 may include rotating a rotating member at 889. The rotating member may be rotated with a first rotational rate. In some embodiments, the rotating member may be a drill string or a sub rotationally connected to a drill rig (e.g., drill rig 103 of FIG. 1) at the surface. In other embodiments, the rotating member may be rotationally independent of the drill table or other drilling equipment at the surface, such as a rotating member rotated by a downhole motor. The method 888 may further include rotating an independently rotating member at 890. In some embodiments, the independently rotating member may be a roll stabilized platform, such as a rotary steerable system. In some embodiments, the independently rotating member may be internal to the rotating member. In some embodiments, the independently rotating member and the rotating member may rotate about the same rotational axis.

The independently rotating member may be rotated with a second rotational rate. In some embodiments, the first rotational rate and the second rotational rate may be different. Thus, the independently rotating member and the rotating member may rotate at different rotational rates. In some embodiments, the rotating member may rotate relative to the independently rotating member. In other words, the independently rotating member may be a non-rotating member, while the rotating member rotates with respect to the independently (or non-rotating) member. For example, the independently rotating member may not rotate relative to absolute north, magnetic north, a force of gravity, or the drill rig at the surface. In this manner, the independently rotating member is a non-rotating member. In other examples, the first rotational rate may be greater than the second rotational rate, and therefore, the rotating member may rotate relative to the independently rotating member. In some embodiments, the first rotational rate has the same sign (e.g., clockwise or counterclockwise) as the second rotational rate. In other embodiments, the first rotational rate has a different sign (e.g., clockwise or counterclockwise) as the second rotational rate. In still other embodiments, the first rotational rate and the second rotational rate may be the same.

The method 888 may further include activating a solenoid on the independently rotating member at 891. In some embodiments, the solenoid may be physically located on the independently rotating member. In other embodiments, the solenoid may be rotationally connected to the independently rotating member. In other words, rotating the independently rotating member may include rotating the solenoid. Rotating the solenoid may include rotating the solenoid at the second rotational rate.

Activating the solenoid may include actuating a moving member. For example, activating the solenoid may induce a magnetic field, which may attract or repel a magnetic moving member. The moving member may move linearly toward or away from the solenoid, thereby actuating the moving member. In some embodiments, the moving member may be on the rotating member. For example, the moving member may be rotationally connected to the rotating member. In other words, rotating the rotating member may include rotating the moving member. Rotating the moving member may include rotating the moving member at the first rotational rate. The moving member may actuate (or move linearly toward or away from the solenoid) while rotating. In other words, rotating the moving member does not stop during activation of the solenoid or actuation of the moving member.

Actuating the moving member may result in the activation or actuation of a downhole tool on the rotating member at 892. Activating the downhole tool may therefore be based on or as a result of the actuation of the moving member. In turn, this means that activating the downhole tool may be based on or as a result of the activation of the solenoid. In other words, activating the solenoid may activate the downhole tool through the moving member. In some embodiments, actuation of the moving member may open a pilot valve, and opening the pilot valve may activate the downhole tool. In other embodiments, actuation of the moving member may directly activate the downhole tool. In some embodiments, the downhole tool may be a mud pulse telemetry system. Thus, the moving member may actuate a pilot valve for the mud pulse telemetry system. Therefore, the method 888 may include generating a pressure pulse with a mud pulse telemetry system each time the moving member is actuated. In other embodiments, the downhole tool may be an expandable tool. In still other embodiments, the downhole tool may be any other downhole tool.

Figure 9:
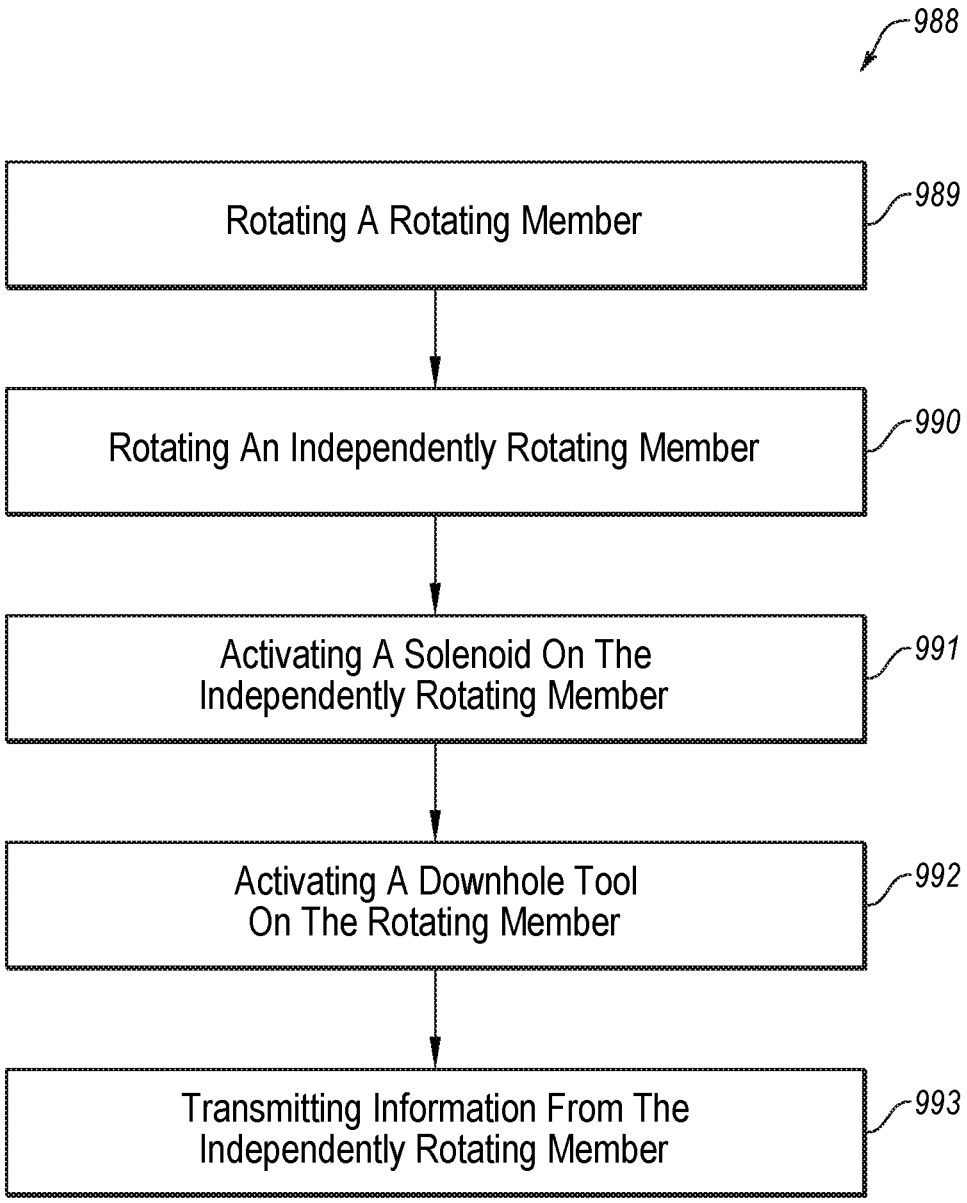
FIG. 9 depicts a method for operating a downhole connection, according to at least one embodiment of the present disclosure.

FIG. 9 is method chart for a method 988, according to at least one embodiment of the present disclosure. The method 988 may include some or all of the same features and elements of the method 888 of FIG. 8. The method 988 may include rotating a rotating member at 989. The method 988 may further include rotating an independently rotating member at 990. A solenoid on the independently rotating member may be activated at 991. Activating the solenoid may actuate a moving member. Actuating the moving member may activate a downhole tool on the rotating member at 992.

The method 988 may further include transmitting information from the independently rotating member to the rotating member at 993. In some embodiments, transmitting information may include activating the solenoid in a pattern. Data may be encoded into the pattern, for example, by selectively changing the length of activation and deactivation of the solenoid. The solenoid may be activated in the pattern that includes encoded data, which will actuate the moving member in the pattern. In some embodiments, an actuation sensor may sense the actuation and de-actuation of the moving member. The data may be decoded from the pattern sensed by the actuation sensor. In this manner, information (e.g., the data) may be transmitted from the independently rotating member to the rotating member.

In some embodiments, the moving member may be connected to a pilot valve of a downhole tool. In this manner, as the moving member is selectively actuated by the solenoid, the downhole tool may be selectively actuated. If the downhole tool is a mud-pulse telemetry system, then data encoded into the actuation pattern of the moving member may be repeated as mud pulses, which may be received at any tool capable of receiving the mud pulses, including the surface. Therefore, the method 988 may include generating a pressure pulse with a mud pulse telemetry system each time the moving member is actuated. In this manner, information collected at the independently rotating member may be transmitted to a rotating member, or any member of a drilling system that can receive pressure pulses and rotates at a different rotational rate from the independently rotating member.

In some embodiments, the independently rotating member may include one or more sensors. For example, the independently rotating member may include an MWD or an LWD tool. The sensors on the independently rotating member may measure a measurement. The measurement may then be encoded into a pattern, and the solenoid activated in the pattern. In this manner, the information transmitted from the independently rotating member to the rotating member may include a measurement from a sensor.

The embodiments of the downhole connection have been primarily described with reference to wellbore drilling operations; the downhole connection described herein may be used in applications other than the drilling of a wellbore. In other embodiments, downhole connections according to the present disclosure may be used outside a wellbore or other downhole environment used for the exploration or production of natural resources. For instance, downhole connections of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole connection, the downhole connection comprising:

a rotating member including a magnetic conductor;

an independently rotating member rotatable relative to the rotating member, the independently rotating member including a solenoid rotationally fixed to the independently rotating member; and a moving member connected to the rotating member and connected to an actuation valve of a downhole tool rotationally connected to the rotating member, wherein:

the magnetic conductor is disposed between a surface of the solenoid and the moving member, wherein the magnetic conductor is configured to extend a magnetic field generated when the solenoid is activated; and the moving member is movable from a first position to a second position by the magnetic field.

2. The downhole connection of claim 1, the downhole tool comprising a mud pulse generator, wherein the moving member is moveable to the second position to open a flow path to the mud pulse generator.

3. The downhole connection of claim 1, the downhole tool comprising an expandable tool, wherein the expandable tool is movable from a retracted position to an expanded position when the moving member is in the second position.

4. The downhole connection of claim 1, the moving member being rotationally fixed to the rotating member.

5. The downhole connection of claim 1, the actuation valve including a flow adjustment member connected to the moving member, the flow adjustment member configured to change a fluid flow through a Venturi constriction as the moving member moves between the first position and the second position.

6. The downhole connection of claim 1, the actuation valve including:

a cylindrical piston with piston threads on an inside of the cylindrical piston, the cylindrical piston being longitudinally movable relative to the solenoid;

a rotor having rotor threads threaded into the cylindrical piston threads such that as the piston moves longitudinally, the rotor rotates in conjunction with the rotor threads threaded into the piston threads, the rotor including a paddle with a rotor opening; and a partition connected to the rotor at the paddle, the partition having a port, wherein in a first rotor position, the rotor opening and the port are misaligned such that no fluid passes through either the rotor opening and the port, and in a second rotor position, the rotor opening and the port are at least partially aligned such that fluid may pass through a combined opening of the rotor opening and the port.

7. The downhole connection of claim 1, wherein:

the solenoid has a surface; and the magnetic conductor has a surface complementary to the surface of the solenoid, wherein a gap is present between the surface of the solenoid and the surface of the magnetic conductor.

8. A mud pulse telemetry system, comprising:

a rotating member including a mud pulse generator, the mud pulse generator including low pressure position and a high pressure position;

a roll stabilized platform rotatable relative to the rotating member; and a valve including:

a solenoid rotationally fixed to the roll stabilized platform; and a moving member configured to move longitudinally with respect to the solenoid from a first position to a second position based on activation of the solenoid, the moving member actuating the mud pulse generator.

9. The mud pulse telemetry system of claim 8, a magnetic attraction between the solenoid and the moving member moving the moving member from the first position to the second position, the moving member causing the mud pulse generator to change from the low pressure position to the high pressure position.

10. The mud pulse telemetry system of claim 9, a return force urging the moving member from the second position to the first position upon deactivation of the solenoid, the moving member causing the mud pulse generator to change from the high pressure position to the low pressure position.

11. The mud pulse telemetry system of claim 8, wherein in the second position a fluid path is formed into the mud pulse generator, and wherein fluid entering the fluid path causes drilling fluid in the mud pulse generator to be restricted through the mud pulse generator.

12. The mud pulse telemetry system of claim 8, the rotating member further including a magnetic conductor fixed to the rotating member, and wherein a fixed gap is present between the magnetic conductor and the solenoid when the moving member is in the first position and the second position.

13. The mud pulse telemetry system of claim 8, the roll stabilized platform including a control unit, the control unit selectively energizing the solenoid to actuate the moving member.

14. The mud pulse telemetry system of claim 13, the control unit selectively energizing the solenoid based on a pattern, the pattern including encoded data.

15. The mud pulse telemetry system of claim 14, the roll stabilized platform including a sensor, the encoded data including a measurement measured by the sensor.

16. A method for operating a downhole connection, the method comprising:

rotating a rotating member with a first rotational rate, wherein the rotating member includes a magnetic conductor;

rotating an independently rotating member with a second rotational rate, wherein the independently rotating member includes a solenoid;

activating the solenoid on the independently rotating member to create a magnetic field, the magnetic field moving a moving member from a first position to a second position, wherein the magnetic field is extended to the moving member by the magnetic conductor disposed between the solenoid and the moving member; and activating a downhole tool when the moving member is in the second position.

17. The method of claim 16, further comprising transmitting information from the independently rotating member to the rotating member.

18. The method of claim 17, further comprising measuring a measurement with a sensor on the independently rotating member, the information including the measurement.

19. The method of claim 18, wherein transmitting information includes:

encoding the measurement in a pattern; and moving the moving member from the first position to the second position in the pattern.

20. The method of claim 16, further comprising generating a pressure pulse with a mud pulse telemetry system when the moving member is in the second position.

21. A downhole connection, the downhole connection comprising:

a rotating member;

an independently rotating member rotatable relative to the rotating member, the independently rotating member including a solenoid rotationally fixed to the independently rotating member; and a moving member connected to the rotating member, the moving member being movable by the solenoid and connected to an actuation valve of a downhole tool rotationally connected to the rotating member, wherein the actuation valve includes:

a cylindrical piston with piston threads on an inside of the cylindrical piston, the cylindrical piston being longitudinally movable relative to the solenoid;

a rotor having rotor threads threaded into the cylindrical piston threads such that as the piston moves longitudinally, the rotor rotates in conjunction with the rotor threads threaded into the piston threads, the rotor including a paddle with a rotor opening; and a partition connected to the rotor at the paddle, the partition having a port, wherein in a first rotor position, the rotor opening and the port are misaligned such that no fluid passes through either the rotor opening and the port, and in a second rotor position, the rotor opening and the port are at least partially aligned such that fluid may pass through a combined opening of the rotor opening and the port.

* * * * *